US007034216B2

(12) United States Patent
DiPietro

(10) Patent No.: US 7,034,216 B2
(45) Date of Patent: Apr. 25, 2006

(54) COMBINATION CYMBAL FASTENER AND DRUM-TUNING KEY

(75) Inventor: Robert James DiPietro, 88 Summit St., Brooklyn, NY (US) 11231

(73) Assignee: Robert James DiPietro, Brooklyn, NY (US)

( * ) Notice: Subject to any disclaimer, the term of this patent is extended or adjusted under 35 U.S.C. 154(b) by 0 days.

(21) Appl. No.: 10/923,317

(22) Filed: Aug. 21, 2004

(65) Prior Publication Data

US 2005/0056137 A1 Mar. 17, 2005

Related U.S. Application Data

(60) Provisional application No. 60/502,450, filed on Sep. 12, 2003.

(51) Int. Cl.
*G10D 13/02* (2006.01)

(52) U.S. Cl. ..... 84/411 R

(58) Field of Classification Search ..... 84/411 R, 84/411 M, 411 A, 413, 421
See application file for complete search history.

(56) References Cited

U.S. PATENT DOCUMENTS

| | | | | |
|---|---|---|---|---|
| 151,797 | A | 6/1874 | Rawson | |
| 2,132,105 | A | 10/1938 | Gladstone | |
| 3,427,917 | A | 2/1969 | Thompson | |
| 4,208,942 | A * | 6/1980 | Henrit | 84/421 |
| 4,216,695 | A | 8/1980 | Hoshino | |
| 5,193,418 | A | 3/1993 | Behrenfeld | |
| D338,484 | S | 8/1993 | Richfield | |
| D404,986 | S | 2/1999 | Mahon | |
| D407,895 | S | 4/1999 | Staley | |

* cited by examiner

*Primary Examiner*—Kimberly Lockett

(57) ABSTRACT

A combination cymbal fastener and drum-tuning key forms a T-shaped tool (14) having a handle (30) connected to a shaft (32). The shaft (32) has an internal cavity (40), circular in cross section, which is threaded (38) for attaching the tool (14) to a threaded rod (44) of a cymbal stand (6). Ultimately, the internal cavity (40) penetrates the end of the shaft (32) nearest to the handle (30), creating an entrance hole (42) by which the threaded rod (44) of a cymbal stand (6) may enter the tool (14). At the tip of shaft (32) located opposite the handle (30), the shaft (32) contains a tuning socket (34). The tuning socket (34) is square in cross section and fitted to slidably mate with a drum's tuning screw (22). Alternative embodiments are also described.

20 Claims, 10 Drawing Sheets

PRIOR ART

PRIOR ART

COMBINATION CYMBAL FASTENER AND DRUM-TUNING KEY

CROSS REFERENCE TO RELATED APPLICATIONS

This application claims the benefit of PPA Ser. No. 60/502,450 filed Sep. 12, 2003, by the present inventor.

FEDERALLY SPONSORED RESEARCH

Not Applicable

SEQUENCE LISTING OR PROGRAM

Not Applicable

BACKGROUND OF THE INVENTION

1. Field of Invention

This invention relates to tools for musical instruments, specifically to an improved tuning tool for drums.

2. Background of the Invention

Drums are one of the oldest and most popular of the musical instruments. A drum is normally comprised of a shell and a membrane. The membrane is struck, causing vibrations throughout itself and the shell, and sound is created. Typically, the tighter a membrane is stretched over the shell, the higher the pitch it will emit. The looser the membrane is allowed to hang on the shell, the lower the pitch it will emit. Traditionally the membrane was made of animal skin and was fastened to the shell of the drum with rope. However, over the years, drummers in need of versatility have made adaptations to the traditional system.

In a modern system, the membrane, now referred to as a drumhead, is attached to a ring-like rim that is connected in several places to tightening screws that in turn are threadedly connected to mountings on the shell. Turning these screws, which are at different locations on the rim, varies the tension of the drumhead. Changing the tension of the drumhead ultimately produces different effects on the sound produced by the drum. Sometimes, each screw has a turning handle of its own which is a part of that screw. But more often, because of the number of tuning screws on a drum, perhaps a dozen or more, the tuning screws end in a usually square-shaped head with which a drum-tuning key is used. The drum-tuning key usually has a square-shaped socket to match the square-shaped cross section of the tuning screw head. The drum-tuning key is slid onto the tuning screw head, the key is turned to turn the screw, and the key is removed.

Drummers commonly need these drum-tuning keys in the practical everyday use of their drums. Typically, a drummer may need to tune the drums on a regular basis. Additionally, drum-tuning keys are used not only to tune the drums, but also to adjust much of the hardware associated with the normal use of drums. A stand is necessary to hold and support a drummer's instruments, such as one or more cymbals and/or drums, and is a common example of such hardware.

Hardware is typically made from metal, with various handles for adjusting the height and lengths suiting a particular drummer's tastes. However, often that hardware also uses additional fasteners in order to secure its positioning. These additional fasteners, sometimes called memory locks, ensure the normal user that the hardware will always be in the same position. These additional fasteners normally do not have handles for adjustment, but rather use screws that are similar in shape to tuning screws. They each have a head, which is usually square in cross-section and which is usually fastened using the tuning socket of a drum-tuning key. Therefore, as with tuning a drum, a drum-tuning key is necessary to adjust these additional fasteners. Only after a drum-tuning key properly adjusts these additional fasteners will the hardware finally be set to a preferred state for the user.

Traditionally, drum-tuning keys are small and are kept separate from a drummer's hardware. However, these keys are easily lost because of their small size and the transient nature of their use.

In the past, other inventors have attempted to make the drum key readily accessible so that it may not be so easily lost. The most popular solution fastened the drum key to the normal everyday key chain of its user, by providing a small hole though the drum-tuning key through which an ordinary key ring might fit. However, it proves to be bulky and awkward to use a drum-tuning key with everyday house and car keys attached.

U.S. design patent D407,895 offered an alternative system for fastening the drum-tuning key to an everyday key chain. A key-ring-attached harness was created from which the drum-tuning key may be removed, so that the user may free the drum key from the everyday key chain while using the key.

However, both solutions have their additional disadvantages, (a) It is awkward to have the drum-tuning key attached to the key ring at all times during the ordinary use of house and car keys.

(b) The everyday key chain may not be readily accessible during a performance. For example, a female drummer may keep keys in a purse, which is not usually carried on stage.

(c) Constantly removing the everyday house and car keys from one's bag or pocket just so the drum-tuning key may be used promotes the casual loss of those other keys.

U.S. Pat. No. 5,193,418 created a different solution. A clip is attached to the drum key so that the drum key may be fastened to any existing tubular hardware surrounding the drummer. This device has disadvantages, (a) The drum key must ultimately be removed from wherever it is temporarily fastened because it is likely to fall off while it is stored inside a drum travel case. The clip-like connection is not strong enough to resist the pressure caused by the other hardware next to which it is stored.

(b) The clip-like appendage, which is attached to the drum key, makes the shape of the drum key awkward, unusual, and sometimes uncomfortable for the user to hold during normal tuning use.

U.S. Pat. No. 4,208,942 to Henrit created a solution, other than my own, in which the drum-tuning key is also used as a cymbal fastener. Screw threading was added to the inside walls of the female square tuning socket. Before Henrit, the square tuning socket on a conventional tuning key was only used to receive the square-headed tuning screw. In Henrit, the tuning socket may be also be screwed onto a round male bolt-like rod using screw threads (i.e. onto a threaded rod forming part of a cymbal stand) in addition to being slidably fastened to a square-headed male tuning screw.

However, a device according to Henrit's patent has disadvantages, (a) Because the female threads are added to the inside of the square female tuning key socket, they must undergo the stress that is normally exerted on the socket while the Henrit device is being used as a drum-tuning key. Any torque applied to the key has a tendency to damage the threads over time, ultimately rendering them useless. Therefore, the use of the Henrit device as a drum-tuning key would probably lessen its functionality as a cymbal holder on the cymbal stands by ruining the screw threads.

(b) In order for the Henrit device to work, the dimensions of the square female tuning socket and the round screw-like object that enters the socket must be very similar in their dimensions. Therefore, any alternative screw-like object whose diameter is too great or too small in comparison to the tuning socket could not be accommodated since the threads of the square tuning socket must be able to thread onto the round screw-like object. This causes a problem largely because the diameter of most contemporary cymbal rods (round bolt-like objects) is 8 millimeters (0.31 inch), which is larger than the 6 millimeter rods formerly in common use. Since the female tuning socket of the Henrit device is only approximately a ¼ inch (0.25 inch) wide, the diameter of the contemporary cymbal rod 8 millimeter (0.31 inch) is actually larger than the tuning socket. Therefore, the male 8 millimeter (0.31 inch) cymbal rod is too large and will not fit inside of the female ¼ inch (0.25 inch) tuning socket while leaving enough unthreaded surface inside the socket to effectively act as a tuning key. These common modern cymbal rods make it difficult to use this older device. Most modem threaded cymbal rods are commercially made with an 8 millimeter diameter, with the usual variations due to manufacturing tolerances. The square heads on modem drum tuning screws are usually made with a quarter-inch dimension on each side of the square, with the usual variations due to manufacturing tolerances.

(c) The depth of the Henrit tuning socket taken from measurements of the patent drawings is approximately half an inch. This tuning socket is also threaded to receive the threaded cymbal rod. However, many or most commercial cymbal rods contain an unthreaded nib at the top of the rod, which is approximately a quarter-inch long. Therefore, the Henrit threaded socket would only be attached to the cymbal rod for the length of a quarter inch after the threaded cymbal rod enters the female tuning socket. The first quarter inch of the threaded socket would not attach itself to the cymbal rod because of the unthreaded quarter-inch nib. This would usually provide a connection which not sturdy, approximating only a quarter inch of threading. If during a performance a drumstick were to strike that type of tuning key and cymbal holder, it might easily detach itself from the cymbal stand.

(d) The Henrit prior art combination device sits above the cymbal in an upright "T" manner where the handle of the device awkwardly protrudes atop the center of the cymbal, creating an obstruction in the immediate playing surface surrounding the device. Therefore, by invading the performer's playing area, it may be a nuisance to the performer.

(e) Since the tuning key socket has a square cross section and the threaded cymbal rod has a circular cross section, the fastening system must necessarily be adjusted in order for the Henrit device to be workable. The threads inside the square-shaped tuning socket are made so as not to be continuous. This is because an item with a circular cross section can not fit perfectly inside of a square hole. Therefore, only part of Henrit's square-shaped tuning socket attaches itself via threads to the threaded rod of a cymbal stand. This may not provide the most secure connection between the tool and the rod of a cymbal stand since the rod is not secured in all directions by the square tuning socket. Thus, the use of the Henrit device as a combination drum-tuning key and cymbal fastener would probably lessen its effectiveness as a cymbal fastener.

BACKGROUND OF THE INVENTION—OBJECTS AND ADVANTAGES

In my device, the tuning key, when not being used to tune drums, may be fastened to a cymbal stand in a secure manner. Being securely fastened, it can endure the abuse associated with being carried about inside a drummer's hardware case during storage and travel. The conventional shape of the prior art drum key is not severely altered in my invention. Thus, it is comfortable to use, familiar to the user, and its shape is not complicated with clips or unusual appendages protruding off of its main body. The screw threads of the fastener portion are kept separate from the tuning socket in the drum key portion, so that the pressure normally exerted on the drum key portion never damages the screw threads of the fastener portion. The combination of the two devices, a cymbal holder and drum-tuning key, does not lessen the efficiency of either one.

Not all cymbal stands are built identically or with threaded rods of identical diameter. Therefore, because my device uses a design in which the screw threads of the fastener portion are kept separate from the square tuning socket in the drum-tuning key portion, the presence of the tuning socket does not predetermine the diameter, which can be used for the fastener portion. My design is adaptable in order to accommodate various cymbal-stand-rod sizes and diameters.

The threaded cavity of the device fastens securely to the threaded rod in the cymbal stand because the entire cavity inside a first end of the vertical shaft, limited only by the square tuning socket on a second end of the shaft, can be threaded. This provides ample length, accommodating even long cymbal rods containing an unthreaded nib atop their rod. Once the threaded rod of a cymbal stand enters my device, there is still enough length in the threaded cavity of the shaft for the device to attach itself securely to the cymbal rod. The device can be placed atop a cymbal stand without intruding on the surface of the cymbal and thus without obstructing the performing area of the cymbal or detracting from the appearance of the cymbal stand It remains readily available for use while also fulfilling a different function as a cymbal fastener when it is not being used as drum-tuning key. It may also be used as a fastener on other hardware, such as a snare drum stand or a hi-hat stand. In practice, it can attach itself to any threaded male screw extending from the hardware as long as the dimensions of the threaded male screw correlate with the dimensions of the female threaded cavity in the fastener portion of the tool.

The drum-tuning key portion is kept separate from the fastener portion within the tool. Thus, the shape of the drum-tuning key portion is not contingent on the shape of the fastener portion. As a result, the tuning socket of the drum-tuning key portion may be altered to fit different types and brands of tuning screws. Instead of having a square shaped tuning socket, the drum-tuning key portion of the tool may have a socket which is circular shaped with a bar dividing the circle. This would be useful if the key were needed to fasten a tuning screw whose head resembles a conventional single slotted screw head, which could be appropriate for the type of drums being used. A few drum companies (i.e. Sonor Drum Company) use tuning screws that resemble the conventional single slotted screws. As a result, there are "special" drum-tuning keys made, by companies like Sonor, to interact with these single slotted tuning screws. Therefore, the drum-tuning key portion of the invention should resemble the tuning portion of these "special" drum-tuning keys if it is intended to interact with these single slotted tuning screws.

Because the drum-tuning key portion of the tool is isolated from the fastener portion, the shape of the drum-tuning key portion is not contingent on the shape of the fastener portion. If the geometric shape of the head of the tuning screw is not the conventional square, but instead is oval, triangular, rectangular, or higher order of polygon, it would be simple to manufacture a drum tuning key having a socket of corresponding geometric shape. Conversely, due to the isolation, the fastening portion could also be altered in shape without predetermining the geometric shape of the drum-tuning key portion. If desired, the fastener portion could be shaped differently than the preferred cylindrical socket Still further objects and advantages will become apparent from a consideration of the ensuing description and drawings.

SUMMARY

In accordance with the present invention, a combination cymbal fastener and drum-tuning key comprises a hand tool having a shaft with a hollow threaded cylindrical socket on a first end of the shaft, a handle firmly attached to the shaft near that first end and extending radially outwardly from the shaft, and a recessed, preferably square socket on a second end of the shaft. The hollowed threaded end of the shaft is adapted to be attached to a cymbal stand while the preferably square socket is adapted to be used as a female receptor for a conventional male drum-tuning screw.

BRIEF DESCRIPTION OF THE DRAWINGS

In the drawings, closely related figures have the same number but different alphabetic suffixes.

DRAWINGS—REFERENCE NUMERALS

Figure 1:
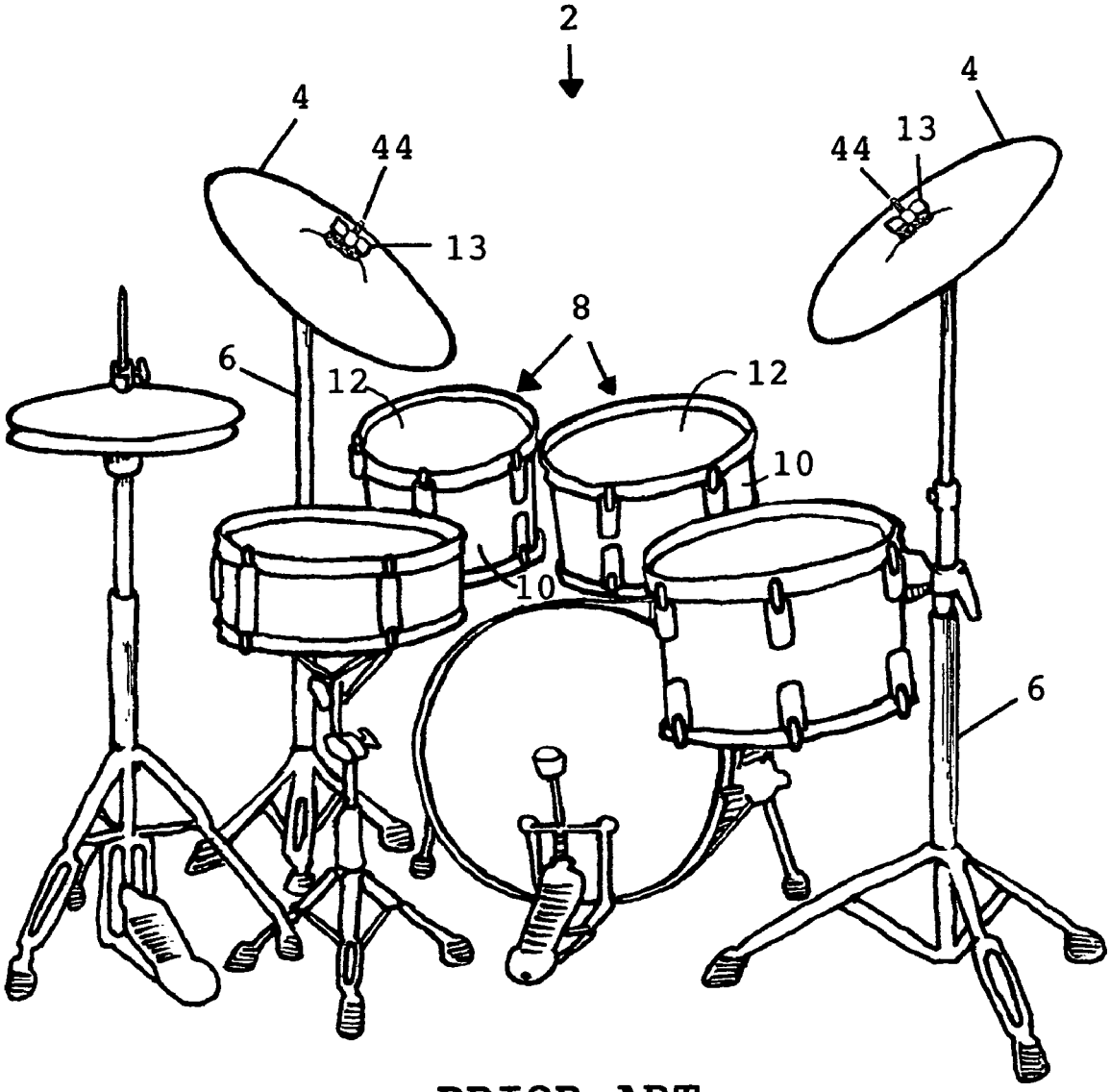
FIG. 1 is a perspective view of a prior art arrangement of percussion instruments typically called a drum set.

2 Drum Set
4 Cymbal
6 Cymbal Stand
8 Drum
10 Drum Shell
12 Drumhead
13 Standard wing nut
14 T-shaped Tool
16 Tuning Screw Head
18 Tuning Screw Collar
20 Tuning Screw's Threads
22 Tuning Screw
24 Shell Mountings
26 Drum Rim
28 Drum Rim Hole
30 Horizontal Handle
31 Thick knurled disc
32 Vertical Shaft
33 Portion of Vertical Shaft where the dimension is greatest
34 Unthreaded Tuning Socket, square in cross-section
36 Interior wall of Tuning Socket
38 Parallel grooves spaced apart in a direction transverse to the vertical shaft
39 Unthreaded portion of alternate internal cavity, circular in cross section, larger in diameter than the threaded portion.
40 Internal Cavity, Threaded, circular in cross-section
41 Interior Wall of Threaded Cavity
42 Threaded Cavity's Entrance Hole
43 Larger entrance hole on threaded cavity
44 Cymbal Rod
46 Cymbal Felt
47 Hole in the center of the Cymbal
48 Bell of the Cymbal
50 Tuning socket for use with conventional style screw heads
52 Interior wall of circular tuning socket
54 Single Bar which divides circular tuning socket
56 Cross Bar which divides circular tuning socket
57 Dimensions of shaft are larger to accommodate alternative embodiment
58 Wing nut-like handle
60 Door knob handle
62 Funneled entrance hole
64 Dimples and Bumps
66 Rubber coating
68 Extra-long shaft

DETAILED DESCRIPTION OF THE INVENTION

FIG. 1 shows a typical prior art arrangement of percussion instruments normally called a drum set 2. The drum set 2 is intended for use by one person, and usually comprises cymbals 4 arranged on stands 6 at the periphery of the set, around drums 8 of different sizes. To a certain extent it is an arrangement of assembled instruments. For example, the drums consist of a drum shell 10 and a drumhead 12, which must be tuned. The cymbals 4 may be disassembled from their stands 6, and the drums 8 may be disassembled from their connection to each other. There is usually a fastener 14 securing the cymbals 4 on their respective stands 6.

Figure 2:
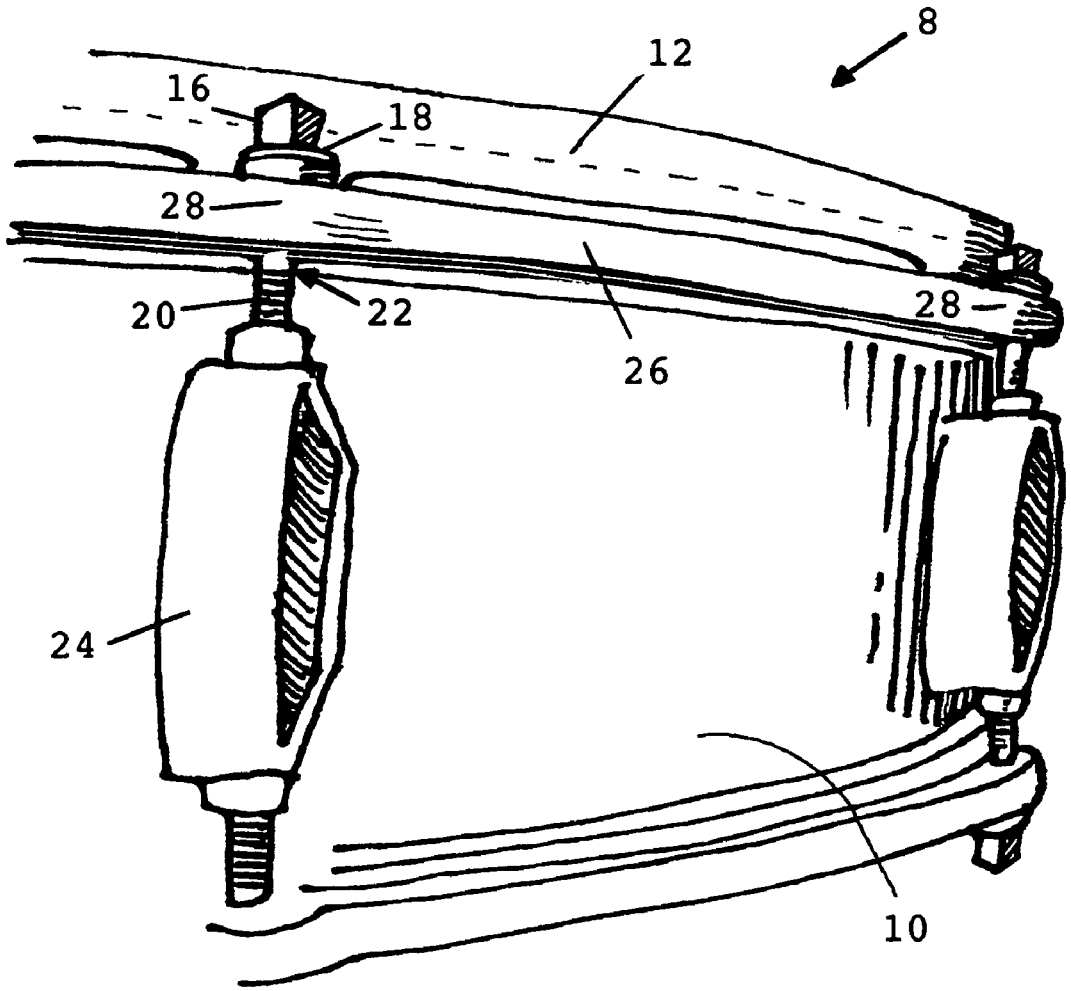
FIG. 2 is a detailed view of a prior art drum and the prior art tuning unit that exists on that drum.

FIG. 2 shows, in detail, a typical prior art arrangement for tuning the drums 8. The drums 8 are tuned by turning tuning-screw heads 16, tightening or loosening threaded tuning screws 22. The drumhead 12 is placed under a ring-like rim 26. The rim 26 has holes 28 at several points through which the threaded tuning screws 22 pass to be threadedly connected to mountings 24 on the drum shell 10. Each screw 22 has a collar 18 beyond which it has a projecting head 16 with a square cross-section. Also, each tuning screw 22 is rotatably mounted through a hole 28 in the rim 26, its threaded portion 20 threadedly connected to the mounting 24. Turning the square projecting head 16 one way or the other moves the threaded end 20 of the screw 22 in or out of the mounting 24, pulling down or releasing the pressure on the rim 26 and hence on the drumhead 12. This drum-tuning arrangement is conventional and well-known to those skilled in the art.

FIGS. 3–6 show the improved tool 14 according to the invention, preferably comprising an integral unit. Since most drum-tuning keys have conventionally been made of metal, or in some cases, other hard materials such as treated plastic, it should also be possible to construct the improved tool 14 according to the invention of any of these materials. If made of metal, it may typically be finished in chrome to enhance its appearance.

The general shape of the preferred embodiment of the tool is that of a T. The T-shape includes of a handle 30 attached at its central portion and extending radially outwardly from a shaft 32 having a central axis. The handle could be but is not necessarily perpendicular to the axis of the shaft It is only necessary that pressure on the handle tends to rotate the shaft about its axis.

Although not necessary, the preferred embodiment of the invention also uses a shaft 32 having a larger diameter in its portion 33 that is attached to the handle 30. This portion 33 of the shaft 32 may be thicker than other portions of the shaft in order to increase the strength of the tool 14 that is attached to the handle 30. However, the thickening is not necessary for the tool to operate, although it may increase its life-expectancy. If the shaft 32 is thicker in this portion 33, the diameter of the internal elongated cavity 40, which exists in this portion 33, can also be thicker, thus providing more flexibility in the dimensions of the internal elongated cavity 40.

Figure 4:
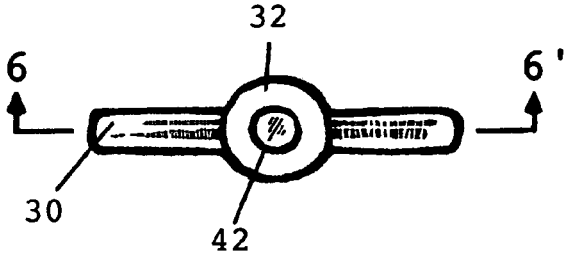
FIG. 4 is a top view of the drum-tuning-key/cymbal-fastener device of FIG. 3, looking down into the threaded cavity of the shaft.
Figure 5:
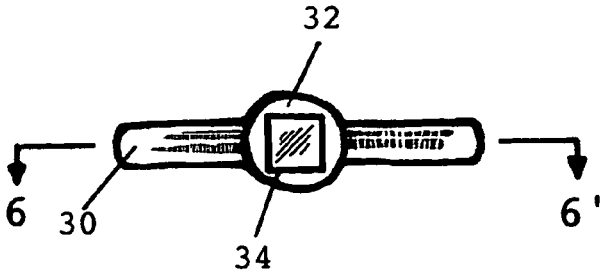
FIG. 5 is a bottom view of the drum-tuning-key/cymbal-fastener device of FIG. 3, looking up into the tuning socket of the shaft.
Figure 6:
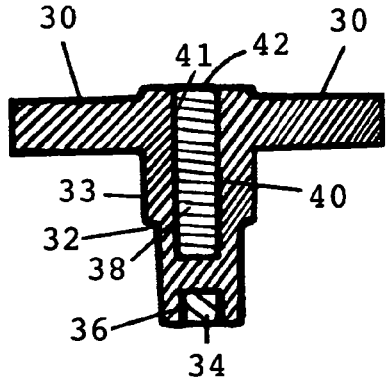
FIG. 6 is a cross-sectional view of the drum-tuning-key/cymbal-fastener device, taken along line 6–6' shown in FIGS. 4 and 5, and displaying its internal screw threading for cymbal fastening and the tuning socket which is fitted to slidably fit over drum-tuning screws.

FIG. 6 shows a cross-sectional view of the tool 14 taken along line 6–6' in FIGS. 4 and 5. A shaft 32 of the tool 14 has an internal elongated cavity 40 that is circular in cross section. This internal elongated cavity 40 extends inwardly along the axis of shaft 32. Starting from an entrance hole 42, located at a first end of the shaft proximate to the handle 30, the internal elongated cavity 40 proceeds toward another point within the shaft 32. Internal walls 41 define the cavity 40. Parallel grooves 38 spaced apart in a direction transverse to the shaft 32, corresponding to a circular thread like that of a nut, are formed in the cavity walls 41 for the purpose of mounting the tool 14 onto a threaded rod 44 of a cymbal stand 6. The internal elongated cavity 40 of the shaft 32 uses these threads 38 in order to attach itself to a threaded male rod 44 of a cymbal stand 6. FIG. 4 shows the entrance hole 42 to the threaded cavity 40 of the shaft 32. It is through this entrance hole 42 that the threaded male rod 44 of a cymbal stand 6 would initially enter the female threaded cavity.

The shaft 32 of the tool 14 also has, at a second end, a tuning socket 34, preferably square-shaped in cross section, which is fitted to receive the head 16 of a drum's tuning screw 22. The tuning socket 34 is defined by interior walls 36, which are not threaded. FIG. 5 shows that the front of the tuning socket 34 is left open in order to receive the head 16 of a drum's tuning screw 22. The cross section of the socket 34 conforms to the usual square-shaped head 16 of the drum-tuning screws 22. In the typical tool 14 the width of the socket 34 might be about ¼ of an inch. The depth of the socket 34 would likely be about ½ of an inch. The outside dimension, or diameter, of the shaft 32 portion surrounding the tuning socket 34, would be about ⅜ of an inch. The internal dimensions are such that the tool 14 may slidably mate with the head of tuning screw 22. The external dimension of ⅜" is small enough that it prohibits any obstruction caused by the rim 26 of the drum 8. If the dimension were too large, the tool 14 would not be able to fit in the tight space allotted by the rim 26, in the area surrounding the head 16 of each tuning screw 22. Thus, the tool 14 could not be used as drum-tuning key if it could not fit in the allotted space. For convenience in machining, or for any other reason, the cavity 40 and the socket 34 may meet inside the shaft 32 without adversely affecting the tool.

Figure 7A:
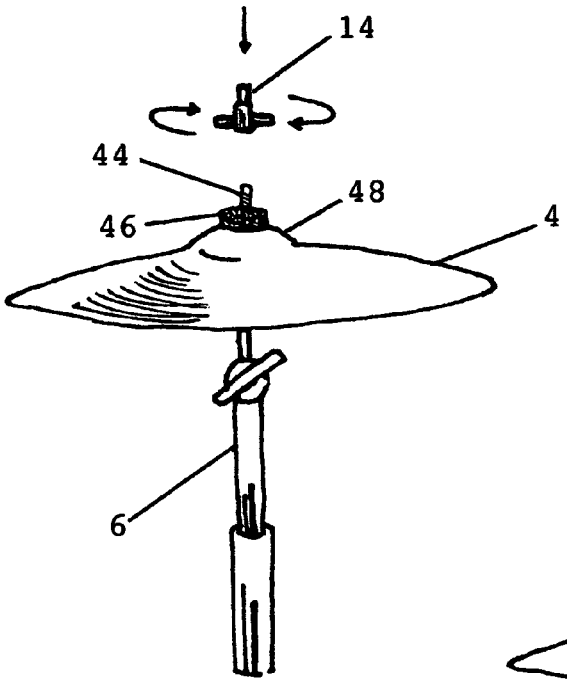
FIG. 7A is a view of the drum-tuning-key/cymbal-fastener device in position as it is being attached, in a screwing motion, to the rod of a prior art cymbal stand holding a cymbal.
Figure 7C:
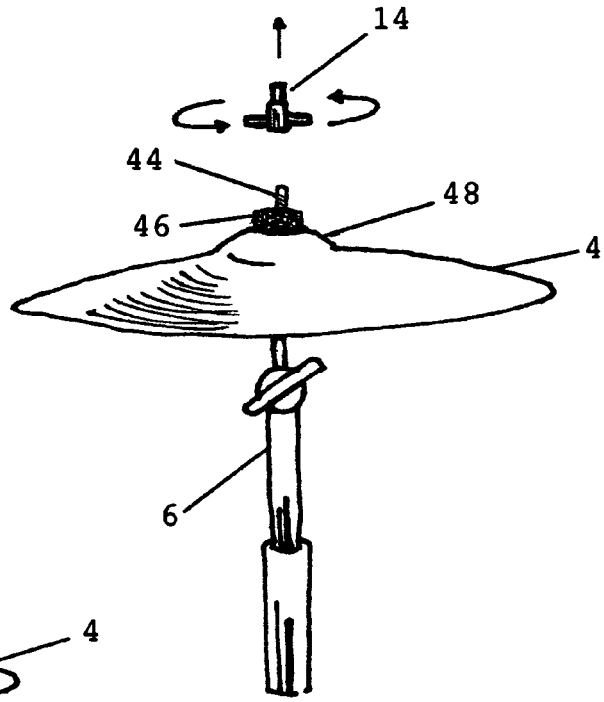
FIG. 7C is a view of the drum-tuning-key/cymbal-fastener device in position as it is being removed, using an unscrewing motion from the rod of a prior art cymbal stand currently holding a cymbal.
Figure 7B:
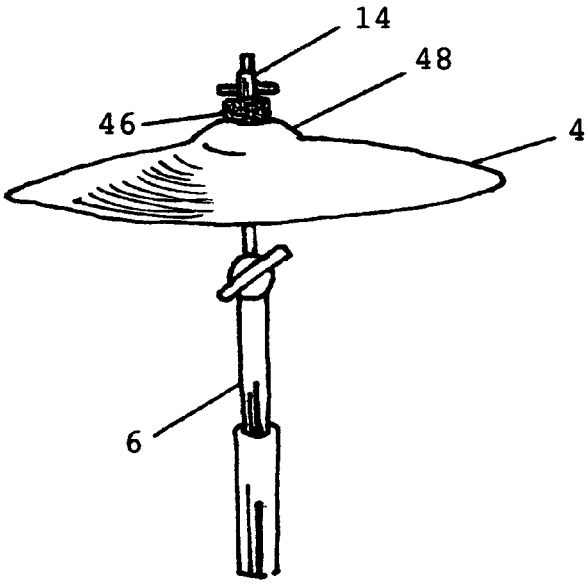
FIG. 7B is a view of the drum-tuning-key/cymbal-fastener device in use as a cymbal fastener attached to the rod of a prior art cymbal stand holding a cymbal.

My invention achieves its result as follows:

FIGS. 7A–7C show the tool 14 in use as a cymbal fastener. Inserting the threaded rod 44 of the cymbal stand 6 through an existing hole 47 in the center of a cymbal 4, a user places the cymbal 4 onto its stand 6. A piece of felt 46 is then placed above the bell 48 of the cymbal 4 in order to cushion the movement of the cymbal 4.

In the prior art, a wing nut 13 is threadedly mounted to the threaded rod 44 of the cymbal stand, directly above the felt, in order to secure the cymbal 4. However, a tool 14, acting as a combination drum-tuning key/cymbal fastener, serves the same function as the wing nut 13, fastening the cymbal 4 on to its stand 6.

In use, the tool 14 would be provided to secure each cymbal 4 to the top of its stand 6. By threadedly engaging the threaded rod 44 of the stand 6, the tool 14 would be mounted above the cymbal felt 46 on the cymbal stand 6.

A user needing to fasten a cymbal 4 to a cymbal stand 6 would normally be in need of a wing nut 13 to secure the cymbal 4 to its stand. However, a user of the present invention would choose to use the tool 14 to serve its purpose as a cymbal fastener, rather than using a wing nut 13.

In FIG. 7A, the tool 14 is in position to be mounted to the stand 6 as a cymbal fastener. The tool 14 is positioned so that the handle 30 is placed on the bottom while the tuning socket 34 is placed on the top. This orientation of the tool 14 as a cymbal fastener is inverted in comparison to its orientation as a drum-tuning key. (See FIG. 8B)

In FIG. 7A, the tool 14 is being threadedly mounted to a cymbal stand. The threaded rod 44 of the cymbal stand 6 is inserted into the tool 14 via the threaded cavity's 40 entrance hole 42. Turning the tool 14 clockwise, the tool 14 will tighten itself to the cymbal rod 44 atop the cymbal stand 6. Gripping either the handle 30 or the shaft 32 of the tool 14 between one's thumb and forefinger, a user may turn the tool 14. A non-slip surface on the handle or the shaft may making turning the tool, especially by the shaft, easier.

FIG. 7B shows the tool 14 in position as it is fastened atop a cymbal stand. The position of the tool 14 places the handle 30 on the bottom next to the felt 46. Placing the tool 14 in the inverted position onto the threaded rod 44 ultimately prevents the handle 30 from becoming an obstruction to the playing area. This is important, particularly in the area around the bell 48 of the cymbal 4.

Now appropriately fastened to the rod 44 of the cymbal stand 6, the cymbal 4 is secured to the cymbal stand 6 by the tool 14. Functioning as a cymbal fastener, the tool 14 serves the same role as conventional wing nut 13 in fastening the cymbal 4 to its stand 6.

A user needing to tune the drums would be in need of a drum-tuning key. Rather than searching for a conventional drum-tuning key, the user would choose to use the tool 14 instead. Because the tool 14 is a combination cymbal fastener and drum-tuning key, the user would easily find the tool 14 already mounted to the rod 44 of a cymbal stand 6, as it securely fastens a cymbal 4 in its place. (See FIG. 7B.) However, in order to use the tool 14 as a drum-tuning key, the tool 14 must first be removed from the cymbal stand 6.

In FIG. 7C, the tool 14, acting as a cymbal fastener, is in position as it is being removed from the stand 6. Once again, the tool 14 is positioned so that the handle 30 is placed on bottom while the tuning socket 34 is placed on top. The tool 14 is turned counterclockwise in order to loosen the tool 14 from the rod 44 of the cymbal stand 6. Gripping either the handle 30 or the shaft 32 of the tool between one's thumb and forefinger a user may turn the tool 14. By turning the tool 14 counterclockwise, the tool is eventually released from the rod 44 of the cymbal stand 6.

At this time, the tool 14 is being held so that the handle 30 is on the bottom. In order to use the tool 14 as a drum-tuning key, the user will need to invert the present position of the tool 14 so that the handle 30 is ultimately placed on top. (See FIG. 8A.)

Figure 8A:
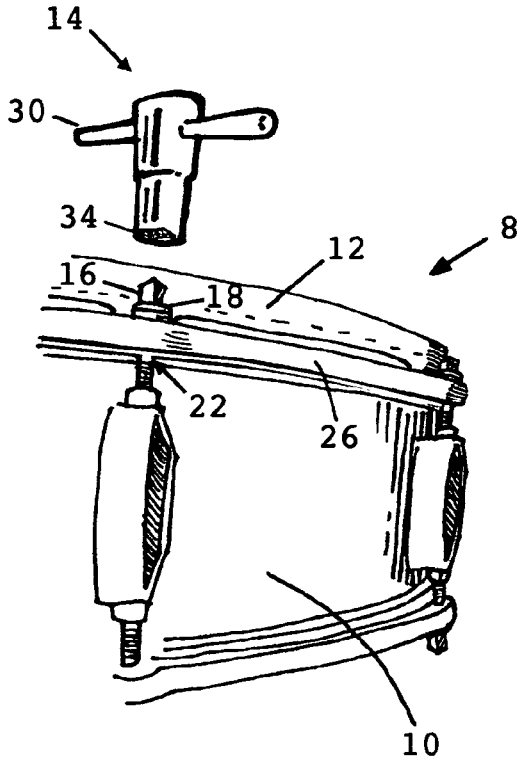
FIG. 8A is a view of the drum-tuning-key/cymbal-fastener device in position to be used as a drum-tuning key. The tuning socket is located on the bottom so that it may slidably mate with the head of the tuning screw.

FIG. 8A shows the tool 14 in position to be used as drum-tuning key. The tool 14 is now positioned so that the handle 30 is placed on top while the tuning socket 34 is placed on bottom. This orientation of the tool 14 as a drum-tuning key is inverted in comparison to its orientation as a cymbal fastener. (See FIG. 7B.)

The bottom of the shaft 32 reveals the opening to the tuning socket 34. The tuning socket 34 is placed above the head 16 of the tuning screw 22 so that it may slidably fit with the head 16 of the tuning screw 22. The tool 14 is then lowered over the head 16 of the tuning screw 22 until the tuning socket 34 of the tool 14 encloses the head 16. The tool 14 will rest on the collar 18 of the tuning screw 22.

Figure 8B:
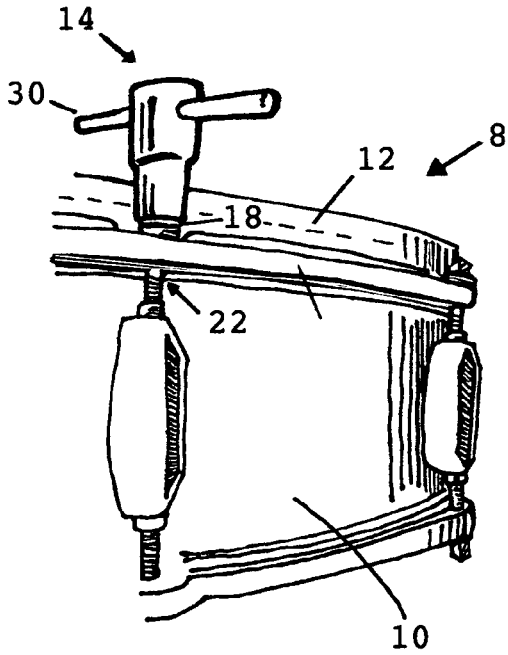
FIG. 8B is a view of the drum-tuning-key/cymbal-fastener device in use as a drum-tuning key. The head of the tuning screw has been enclosed by the tuning socket of the drum-tuning key/cymbal-fastener device.

FIG. 8B shows the tool 14 in position to be used as a drum-tuning key. The female tuning socket 34 of the tool 14 encloses the male head 16 of the tuning screw 22, while it also rests on the collar 18 of the tuning screw 22. With the head of the tuning screw 22 now slidably fastened by the tuning socket 34 of the tool 14, a user may turn the tool 14. Turning the tool 14 will now also turn the head 16 of the tuning screw 22. Consequently, it will also turn the entire tuning screw 22.

The tool may be turned in either a clockwise or counterclockwise direction. Turning the tool 14 in the clockwise direction as viewed from above will tighten the screw 22 while turning it in the counterclockwise direction will loosen the screw 22. Varying the tension of the tuning screws changes the tension of the rim 26 against the shell 10 of the drum 8. Accordingly, the tension of the drumhead 12 will ultimately be affected since the drumhead is pressed between the rim 26 and the shell 10 of the drum 8. Thus, as the tuning screws 22 are tightened, the rim 26 presses down on the drumhead 12, increasing the tension of the drumhead 12, and raising the pitch of the drum. Conversely, as the tuning screws 22 are loosened, the rim 26 releases its pressure on the drumhead 12, decreasing the tension of the drumhead 12, and lowering the pitch of the drum.

DESCRIPTION OF ALTERNATIVE EMBODIMENTS

Figure 9A:
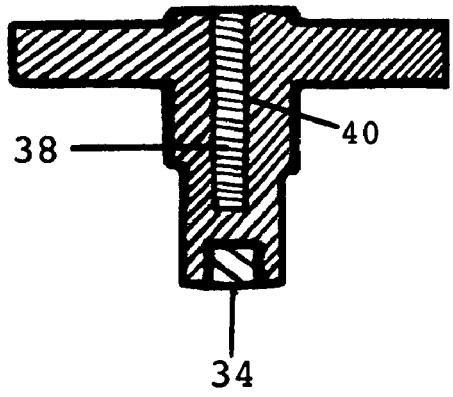
FIG. 9A is a cross-sectional view of the drum-tuning-key/cymbal-fastener device where the diameter of the threaded cavity in the shaft is less than the width of the tuning socket.
Figure 9B:
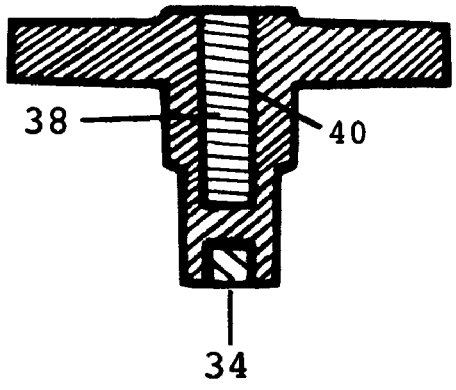
FIG. 9B is a cross-sectional view of the drum-tuning-key/cymbal-fastener device where the diameter of the threaded cavity in the shaft is equivalent to the width of the tuning socket.
Figure 9C:
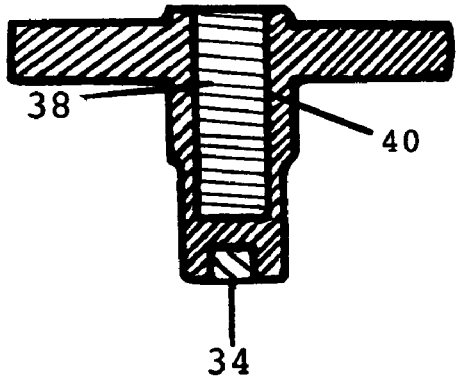
FIG. 9C is a cross-sectional view of the drum-tuning-key/cymbal-fastener device where the diameter of the threaded cavity in the shaft is greater than the width of the tuning socket.

FIGS. 9A–9C shows cross sectional views on three variations of the tool 14, where the dimensions of the threaded cavity 38 and the tuning socket 34 are slightly different.

FIG. 9A shows an example of the tool where the threaded cavity 38 of the shaft 32 is smaller in dimension than the tuning socket 34. This would be useful if the threaded cymbal rod 44 upon which the tool 14 would be mounted was smaller in dimension than the size of the tuning socket 34. Therefore, the size of the threaded cavity 38 could accommodate the size of threaded rod 44 with which it will be used. There is no difficulty presented in making the threaded cavity 38 of the shaft 32 smaller in dimension than the tuning socket 34.

FIG. 9B shows an example of the tool where the threaded cavity 38 of the shaft 32 is similar in dimension to the tuning socket 34. This would be useful if the threaded cymbal rod 44 upon which the tool 14 would be mounted was similar in dimension than the size of the tuning socket 34. Therefore, the size of the threaded cavity 38 could accommodate the size of threaded rod 44 with which it will be used. There is no difficulty presented in making the threaded cavity 38 of the shaft 32 similar in dimension than the tuning socket 34.

FIG. 9C shows an example of the tool where the threaded cavity 38 of the shaft 32 is larger in dimension than the tuning socket 34. This would be useful if the threaded cymbal rod 44 upon which the tool 14 would be mounted was larger in dimension than the size of the tuning socket 34. Therefore, the size of the threaded cavity 38 could accommodate the size of threaded rod 44 with which it will be used. There is no difficulty presented in making the threaded cavity 38 of the shaft 32 larger in dimension than the tuning socket 34.

Because the threaded cavity 38 and the tuning socket 34 each complete a different task as well as occupying a different space within the tool 14, the presence of either one does not influence the structure or performance of the other. Therefore, the tool 14 has flexibility designed into it. As shown in FIGS. 9A–9C, the dimensions of the threaded cavity 38 are not determined by the presence of the tuning cavity 34. The threaded cavity 38 could vary in dimension in order to accommodate the different sizes that exist for the rods 44 of cymbal stands 6. The diameter of the rods 44 may be smaller or larger than the tuning socket 34. However, it would pose no problem for the tool 14 because the threaded cavity 38 could be altered without being restricted by the presence of the tuning socket 34.

Conversely, the tuning socket 34 could be altered without being restricted by the presence of the threaded cavity 38. This would be useful if the shape of the tuning socket 34 needed to be varied in order to accommodate a differently shaped tuning screw other than the square headed norm. For example, if the head of a drum's tuning screw held the single or cross-slot design of conventional screws, the tuning socket could be altered to meet that need. Instead of having a square-shaped socket 34, the tuning portion of the tool could be shaped to accommodate the single or cross-slot design of conventional screws.

Figure 10:
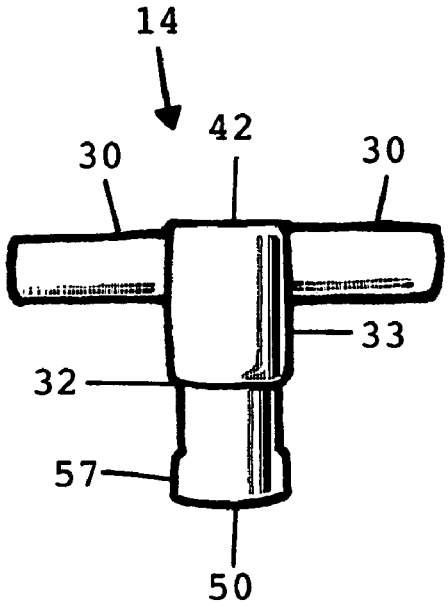
FIG. 10 is a view of an alternative embodiment of the drum-tuning-key/cymbal-fastener device in which the diameter of the portion of the shaft containing the tuning cavity has been made wider in order to accommodate a larger tuning cavity.
Figure 11A:
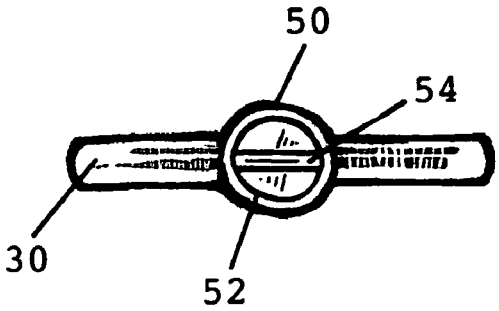
FIG. 11A is a bottom view of an alternative embodiment of the drum-tuning key/cymbal-fastener device of FIG. 14 looking up into the alternative tuning socket of the single bar type.
Figure 11B:
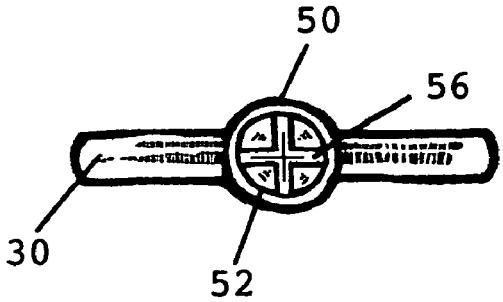
FIG. 11B is a bottom view of an alternative embodiment of the drum-tuning key/cymbal-fastener device of FIG. 14 looking up into the alternative tuning socket of the cross bar type.

FIG. 10 shows a frontal view of an alternative embodiment of the tool 14 which is adapted to work with tuning screw heads which are shaped as are the heads of conventional screws. In order to accommodate larger screw heads, the diameter of the tuning portion 57 of the shaft 32 has been increased, allotting more interior room for an alternative tuning socket 50. FIGS. 11A and 11B are end views of the device of FIG. 10 showing alternative tuning sockets 50 designed for use with conventional style screw heads. The alternative tuning sockets 50 each have interior walls 52 defining a circular cross section. However, the tuning socket in FIG. 11A is specifically designed for use with screws having the single slot design, while the tuning socket in FIG. 11B is specifically designed for use with screws having the cross-slot design. In FIG. 11A, there is a single blade or bar 54 recessed in the alternative tuning socket 50 which also divides part of that socket 50 in two halves. The single bar 54 is intended for interaction with the single slot of a conventional single slotted screw head. In FIG. 11B, there is a cross blade or cross bar 56 recessed in the alternative tuning socket 50 which also divides part of that socket 50 into four quarters. The cross bar 56 is intended for interaction with the cross slot of a cross slotted screw head, such as may be found on a Phillips headed screw. The socket 50 fits down over the slotted head of the tuning screw while fitting the bar or bars inside that socket into the slot or slots in the head of the tuning screw. The socket surrounds the head, preventing the blade from easily slipping out of the slots. Also, there are many possible alternative embodiments of my combination cymbal fastener and drum-tuning key 14.

Figure 3:
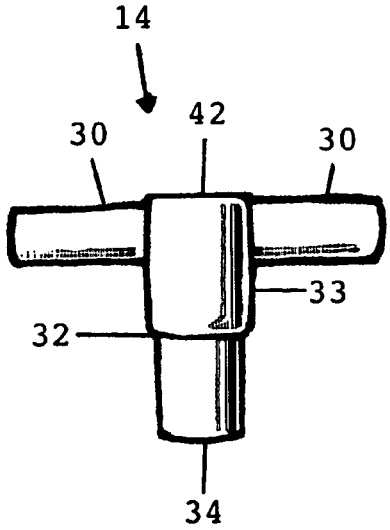
FIG. 3 is a frontal view of a drum-tuning-key/cymbal-fastener device according to the present invention.
Figure 12:
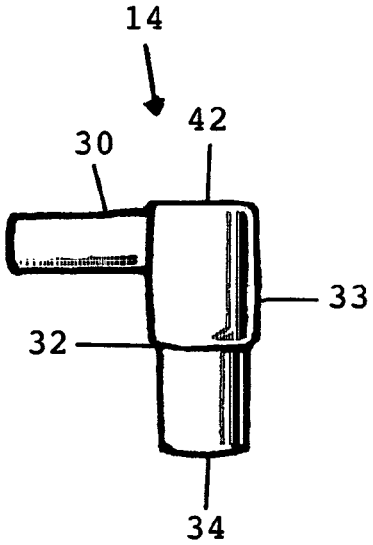
FIG. 12 shows an alternative embodiment of the drum-tuning-key/cymbal-fastener device in which the handle comprises a single appendage extending radially outward from the shaft.
Figure 13:
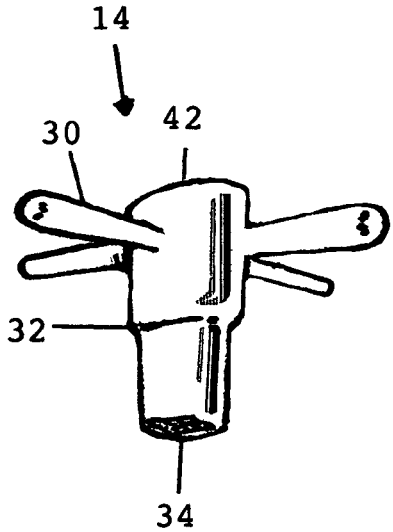
FIG. 13 is a perspective view of an alternative embodiment of the drum-tuning-key/cymbal-fastener device in which the handle comprises multiple appendages extending radially outward from the shaft.

(a) Although the preferred embodiment of FIG. 3 shows the tool to have a basic T-like shape, it is also possible that the tool 14 could assume a different shape. For example, if the handle 30 were to extend in only one direction from the shaft 32 (See FIG. 12), the resulting embodiment would be L-shaped, when viewed in the appropriate orientation. Additionally, FIG. 13 shows an alternative embodiment in which the horizontal handle 30 consists of many bar-like appendages extending radially from the shaft. There could be three, four, five, six or more bar-like appendages extending in preferably equilateral directions from the shaft, thus forming many different shapes of a handle.

Figure 14A:
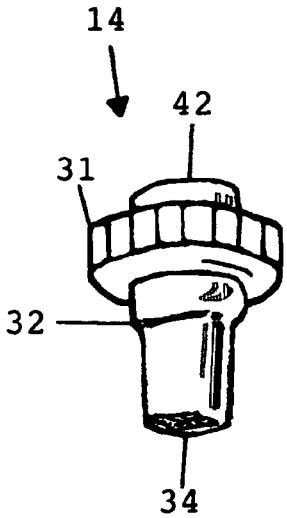
FIG. 14A is a perspective view of an alternative embodiment of the drum-tuning key/cymbal-fastener device in which the handle is in the form of a knurled thick disk.
Figure 14B:
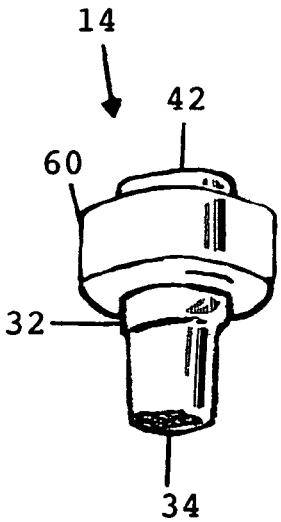
FIG. 14B is a perspective view of an alternative embodiment of the drum-tuning key/cymbal-fastener device in which the handle is in the form of a globular shaped knob.
Figure 14C:
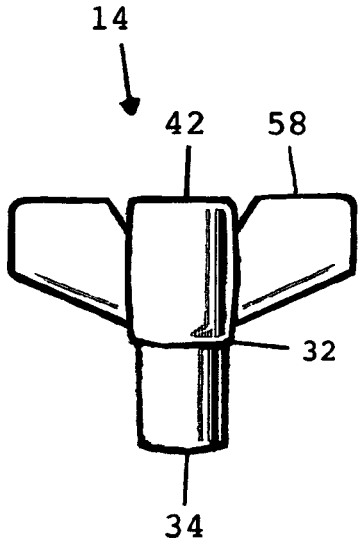
FIG. 14C is a perspective view of an alternative embodiment of the drum-tuning key/cymbal-fastener device in which the handle is in the form of traditional wings from a wing nut.
Figure 15:
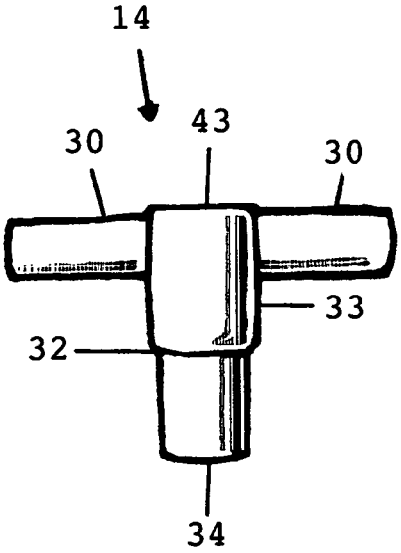
FIG. 15 is a front view of an alternative embodiment of the drum-tuning-key/cymbal-fastener device in which one portion (not shown) of the internal circular cavity is larger in diameter and unthreaded.
Figure 16:
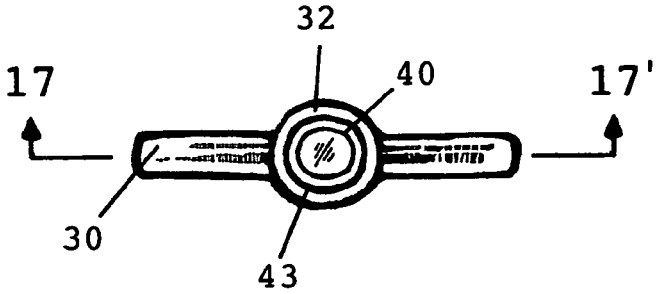
FIG. 16 is a top view of the alternative embodiment of FIG. 15, looking down into an unthreaded entrance hole whose diameter is larger than in the preferred embodiment.

Alternatively the handle could be a thick knurled disk 31 as shown in FIG. 14A, or a globular shape such as a door knob as shown in FIG. 14B. It is also possible that the handle could take the shape of wings of a conventional wing nut as shown in FIG. 14C.

Figure 17A:
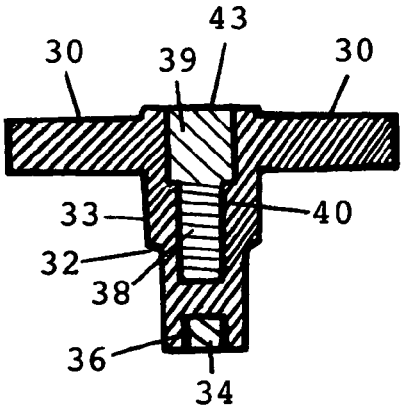
FIG. 17A is a cross-sectional view of the alternative embodiment of FIG. 15, taken along lines shown in FIG. 16, displaying an internal elongate cavity which is both unthreaded and larger in diameter in one portion of that cavity.

(b) Although the preferred embodiment of FIG. 6 shows the threads 38 of the internal elongated cavity 40 existing for the entirety of the internal elongated cavity 40, it is not necessary. It is only necessary that some portion of the internal elongated cavity 40 have these threads 38 for attachment. FIG. 17A shows an internal elongate cavity 40 where one portion 39 of that cavity 40 is unthreaded.

Figure 17B:
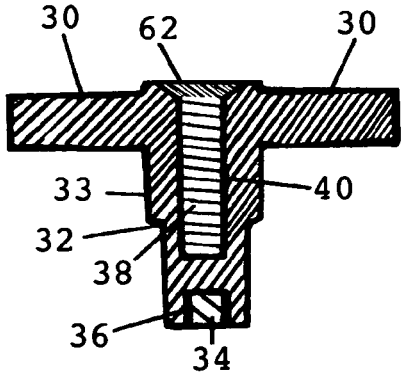
FIG. 17B is a cross-sectional view of an alternative embodiment of FIG. 15, taken along lines shown in FIG. 16, in which the beginning of the threaded cavity is beveled to provide a funnel-like opening, making it easier to begin inserting the threaded rod into the threaded cavity.

(c) Although the preferred embodiment of FIG. 6 shows the internal elongated cavity 40 to be uniform in its dimension, it is also possible that one portion of the internal elongated cavity 40 may be larger in its dimensions than another. For example, if the diameter of most of the internal elongated cavity 40 was 8 mm, it may be useful if the portion near the entrance hole 42 were larger in its dimensions. FIG. 17A shows an internal elongate cavity 40 where one portion 39 of that cavity 40 is larger in its dimensions. This would be helpful if the threaded cymbal rod 44, to which the tool 14 is to be attached, were larger in its dimensions at its base. It might also make it easier to attach the tool to the cymbal rod quickly if the entrance hole 42 funneled 62 it into the threaded cavity 40 as shown in FIG. 17B.

(d) Different materials, sizes, designs, and interconnections could be used for all components of this combination cymbal fastener/drum-tuning key. For example, the tool 14 could be forged in one piece or could be an assembly of smaller pieces. Additionally, the tool 14 could be made of metal or some other strong material such as hardened plastic.

(e) Rather than being solely a cymbal fastener, the tool 14 may also be fastened to any article of hardware (i.e. a snare drum stand) when not in use as a drum-tuning key. It is typical that hardware has many combinations of conventional screws and wing nuts fastening its structure. Therefore, as long as the alternative article of hardware has at least one protruding male threaded rod (i.e. a screw), the tool 14 may attach itself to the hardware. Of course, the dimensions of the internal elongated cavity 40 of tool 14 and the protruding male threaded rod extending from the article of hardware must correlate in order to form a male-female relationship.

(g) The length and shape of the shaft 32 may vary depending upon how much length is needed to reach the head 16 of a tuning screw 22. Additionally, the length and shape of the handle 30 may vary to provide comfort for a user.

(h) The aesthetic appearance of the tool 14 may vary. Both the handle 30 and the shaft 32 could have a shape other than that of a tubular model. Additionally, the color of the tool could vary. For example, it could be any color, or could be plated in either chrome or nickel.

Figure 18A:
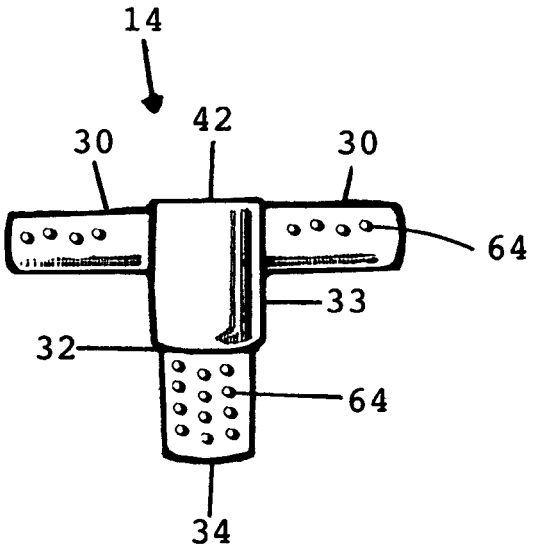
FIG. 18A is a front view of an alternative embodiment of the drum-tuning-key/cymbal-fastener device in which dimples and bumps are added to its outer surface in order to provide a frictional surface for holding the device.
Figure 18B:
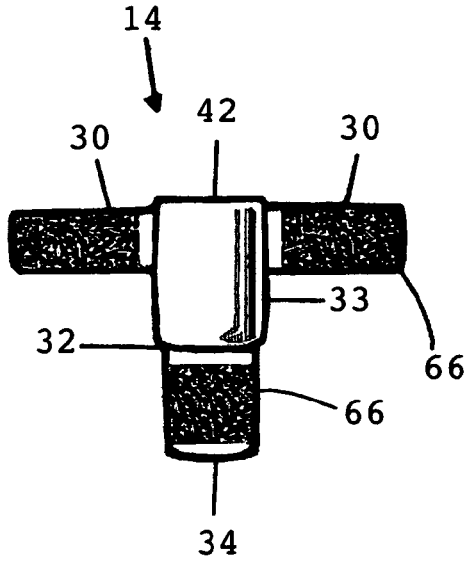
FIG. 18B is a front view of an alternative embodiment of the drum-tuning-key/cymbal-fastener device in which a rubber coating is added to its outer surface in order to provide a frictional surface for holding the device.

(i) The handle 30 and shaft 32 could be altered in order to create a frictional non-slip surface on their respective surfaces. This friction would enhance a user's ability to grip the tool 14 without letting it slip out of the hand. For example, the additional friction could be caused by a rubber coating (See FIG. 18A), or alternatively, by placing bumps and/or dimples (See FIG. 18B) on the respective surfaces of the handle 30 and/or the shaft 32.

Figure 19:
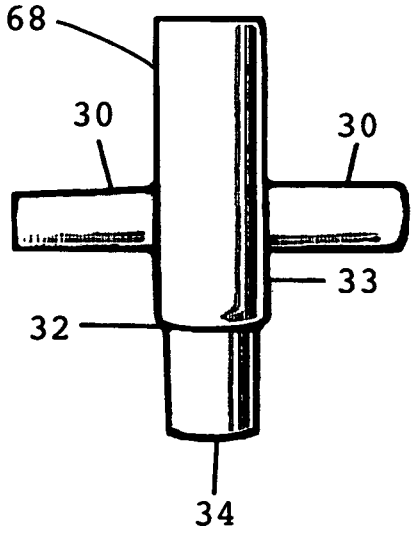
FIG. 19 is a front view of an alternative embodiment of the drum-tuning-key/cymbal-fastener device in which the shaft is longer in length and the handle is situated at the center of that shaft forming a cross-like shape.

(j) The shaft 32 of the tool 14 could be made longer 68 than in the preferred embodiment, and the handle 30 could be situated in the center of the shaft 32 forming a general cross-like shape as shown in FIG. 19.

Thus it will be seen that the combination cymbal fastener and drum-tuning key of the invention provides a highly reliable and effective way of providing two ordinary services for a drummer. It provides an easily locatable drum-tuning key that is typically conventional in both its use and appearance, and also serves as a cymbal fastener to help secure a drummer's cymbals to their stands. The combination of the two functions is symbiotic and causes each of the two functions to operate better than they would on their own. The handy location of the drum-tuning key atop the cymbal stand makes it both more conveniently located and less easily lost. The more ornate features of the drum-tuning key enhances the appearance of the cymbal arrangement over that of the usual simple cymbal fastener.

Furthermore, the combination cymbal fastener and drum-tuning key has additional advantages in that (a) the tool of invention is flexible to meet the changing sizes of cymbal stands, tuning screws, and other hardware.

(b) the cymbal fastener portion can be manufactured in a different and altered form without changing the drum-tuning key portion. Conversely, the drum-tuning key portion can be manufactured in a different and altered form without changing the cymbal fastener portion.

(c) the combination of a cymbal fastener and a drum-tuning key present together in the tool of invention does not limit either function of the tool.

(d) the aesthetic and ergonomic appearance of the tool could be altered to match the tastes of its users.

While my above description contains many specific examples, these should not be construed as limitations on the scope of the invention, but rather as an exemplification of one preferred embodiment thereof. Many other variations are possible. For example, the tuning socket could be shaped differently than a square. Instead, it is possible that it could shaped as a circle, an oval, a trapezoid, or a triangle, etc, if required by the geometric configuration of the tuning screw heads of the drums. If desired, the tuning key portion of the tool could also be shaped to correlate geometrically, in size and in shape, with tuning screw heads resembling conventional single slot or cross-slot designs. The overall resulting shape of the tool could be realized differently than that of a full T-like shape, etc. Accordingly, the scope of the invention should be determined not by the embodiment illustrated, but by the appended claims and their legal equivalents.

I claim:

1. In a drum set including at least one drum, said drum comprising a drumhead stretched over a drum shell and held in tension by a plurality of adjustable tightening screws, each tightening screw having a male turnable head which is square in cross-section and turnable by a tuning key having a corresponding square female socket usable to adjust the tension on the drumhead, the drum set further including at least one cymbal and at least one cymbal stand, the stand terminating in a threaded rod of cylindrical cross section over which the cymbal may be placed and held in place by a female-threaded cymbal fastener, the improvement comprising a combined tuning-key and cymbal-fastener tool, the combined tool comprising a shaft having first and second opposite ends, a handle extending outwardly from the shaft and situated closer to the first end than to the second end, a female threaded cylindrical socket in the first end of the shaft which is sized and threaded to match said threaded rod, a female square socket in the opposite second end of the shaft which is sized to match said male turnable head, whereby, when not in use as a tuning key, the combined tool is used to hold a cymbal in place on the cymbal stand by screwing it onto the threaded rod above the cymbal, and when it is needed as a tuning key, it is removed from the cymbal stand and is used by placing the female square socket over various tightening screws and is turned by the handle to adjust the tightening screws.

whereby, the female threaded cylindrical socket is isolated from the structural pressures exerted on the female square socket, and the dimensions of either socket are independent of the dimensions of the other socket.

2. A device according to claim 1, where in the handle is a bar shaped element extending radially outwardly from the shaft on at least two sides of the shaft and affixed to the shaft.

3. A device according to claim 1, wherein each side of the square cross section of the male turnable head has a length of approximately one quarter of an inch, and wherein the cylindrical cross section of the threaded rod has a diameter of approximately 8 millimeters.

4. A combined cymbal fastener and drum-tuning tool for use with adjustable drum-tightening screws of a given geometric shape and with threaded cymbal securing rods of circular cross section comprising a shaft having first and second opposite ends, a handle extending outwardly from the shaft and situated between the first end and the second end, a female threaded cylindrical socket in the first end of the shaft which is sized and threaded to match said threaded cymbal securing rods, a female socket of said geometric shape in the opposite second end of the shaft which is sized and shaped to match male turnable heads of said drum-tightening screws, whereby, when not in use as a tuning key, the combined tuning key and cymbal fastener is available to hold a cymbal in place on a cymbal stand by screwing it onto the threaded rod above the cymbal, and when it is needed as a tuning key, it is removed from its holding place on the cymbal stand and is used by placing the female square socket over various tightening screws and turning it by the handle to adjust the tightening screws.

5. A device according to claim 4, wherein the handle is a bar shaped element extending radially outwardly from the shaft on at least two sides of the shaft and affixed to the shaft.

6. A device according to claim 4, wherein the handle is a bar shaped element extending radially outwardly from the shaft on at least one side of the shaft and affixed to the shaft.

7. A device according to claim 4, wherein the handle is a wing shaped element extending radially outwardly from the shaft on at least one side of the shaft and affixed to the shaft.

8. A device according to claim 4, wherein the handle is a disc extending radially outwardly from the shaft, encompassing all sides of the shaft and transversely affixed to the shaft.

9. A device according to claim 4, wherein the handle is a knob extending radially outwardly from the shaft, encompassing all sides of the shaft and is affixed to the shaft.

10. A device according to claim 4, wherein the tool comprises a frictional surface on its exterior.

11. A device according to claim 4, wherein said geometric shape is square and wherein each side of the square cross section of the male turnable head has a length of approximately one quarter of an inch, and wherein the cylindrical cross section of the threaded rod has a diameter of approximately 8 millimeters.

12. A device according to claim 4, wherein said geometric shape is square and wherein each side of the square cross section of the male turnable head has a length of approximately one quarter of an inch, and wherein the cylindrical cross section of the threaded rod has a diameter of approximately 6 millimeters.

13. A device according to claim 4, wherein the female threaded cylindrical socket has a funneled entrance on the first end.

14. A device according to claim 4, wherein the female threaded cylindrical socket comprises an unthreaded portion of said cylindrical socket.

15. A device according to claim 4, wherein the female threaded cylindrical socket comprises a portion, larger in its dimensions than the remaining portion of said cylindrical socket.

16. A device according to claim 4, wherein the geometric shape of the female socket is circular, and further comprising a single bar, recessed within and dividing said socket.

17. A device according to claim 4, wherein the geometric shape of the female socket is circular, and further comprising a cross-shaped bar, recessed within and dividing said socket.

18. A tool according to claim 4, wherein the handle is situated closer to the first end than to the second end.

19. A device according to claim 4, wherein the handle is situated at the center of the shaft forming a cross-like shape.

20. A combined tuning-key and cymbal-fastener tool, plated in chrome comprising a structure integrally shaped into the form of a T, comprising a shaft having a first end and a second opposite end, and a handle comprising at least two bar-like bar shaped appendages extending outwardly from the shaft and situated closer to the first end than to the second end, and a female threaded cylindrical socket in the first end of the shaft which has a diameter, of 8 millimeters, and threaded to match said threaded rod, and a female socket in the opposite second end of the shaft which is square and wherein each side of the square cross section of the male turnable head has a length, of one quarter of an inch sized and shaped to match said male turnable heads, whereby a person can tune a drum by turning said male turnable heads on adjustable drum-tightening screws and fasten a cymbal to a threaded rod of circular cross section.

* * * * *